US010429146B2

(12) United States Patent
Garst et al.

(10) Patent No.: US 10,429,146 B2
(45) Date of Patent: Oct. 1, 2019

(54) FIREARM SUPPRESSION DEVICE

(71) Applicant: Ascendance International, LLC, Highlands Ranch, CO (US)

(72) Inventors: Joseph Garst, Highlands Ranch, CO (US); Robert Folaron, Colorado Springs, CO (US)

(73) Assignee: ASCENDANCE INTERNATIONAL, LLC, Highlands Ranch, CO (US)

( * ) Notice: Subject to any disclaimer, the term of this patent is extended or adjusted under 35 U.S.C. 154(b) by 0 days.

(21) Appl. No.: 16/106,750

(22) Filed: Aug. 21, 2018

(65) Prior Publication Data

US 2019/0072352 A1 Mar. 7, 2019

Related U.S. Application Data

(63) Continuation of application No. 15/408,224, filed on Jan. 17, 2017, now Pat. No. 10,107,581.

(60) Provisional application No. 62/279,801, filed on Jan. 17, 2016.

(51) Int. Cl.
*F41A 21/00* (2006.01)
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/34; F41A 21/36
See application file for complete search history.

(56) References Cited

U.S. PATENT DOCUMENTS

| | | | | |
|---|---|---|---|---|
| 2,442,773 | A | 6/1948 | Mason | |
| 2,514,996 | A | 7/1950 | Faust | |
| 4,291,610 | A | 9/1981 | Waiser | |
| 4,576,083 | A * | 3/1986 | Seberger, Jr. | F01N 1/08 181/223 |
| 5,136,923 | A | 8/1992 | Walsh, Jr. | |
| 6,308,609 | B1 | 10/2001 | Davies | |
| 6,374,718 | B1 | 4/2002 | Rescigno et al. | |
| 6,575,074 | B1 | 6/2003 | Gaddini | |
| 7,207,258 | B1 | 4/2007 | Scanlon | |
| 7,308,967 | B1 | 12/2007 | Hoel | |
| 7,832,323 | B1 | 11/2010 | Davies | |
| 8,162,100 | B2 | 4/2012 | Shults et al. | |
| 8,424,441 | B2 | 4/2013 | Brittingham et al. | |
| 8,511,425 | B2 | 8/2013 | LaRue | |
| 8,561,757 | B1 | 10/2013 | Edsall | |
| 8,567,556 | B2 | 10/2013 | Dueck et al. | |
| 8,584,794 | B2 | 11/2013 | Dueck | |

(Continued)

FOREIGN PATENT DOCUMENTS

| | | |
|---|---|---|
| DE | 2540419 A1 | 3/1977 |
| EP | 2191223 B1 | 11/2011 |
| FR | 597737 A | 11/1925 |

*Primary Examiner* — Gabriel J. Klein
(74) *Attorney, Agent, or Firm* — VOZ Patents, LLC

(57) ABSTRACT

The present invention pertains in general to the suppression of firearm and weapon systems to mitigate audible, visual and temperature profiles when in use. Embodiments of the invention include the use of a baffle system surrounded by a sleeve, further surrounded by an outer housing. The combination of these elements creates a multi-volume device providing increased expansion volume within the device to mitigate firearm signature related to the expansion of gasses exiting the muzzle-end of a firearm.

9 Claims, 9 Drawing Sheets

(56) References Cited

U.S. PATENT DOCUMENTS

| | | | | |
|---|---|---|---|---|
| 8,857,306 | B1 | 10/2014 | Edsall | |
| 8,939,057 | B1 | 1/2015 | Edsall | |
| 8,973,481 | B2 | 3/2015 | Dueck et al. | |
| 9,038,770 | B1 | 5/2015 | Morrison | |
| 9,140,511 | B2 | 9/2015 | Michal et al. | |
| 9,658,010 | B1 | 5/2017 | Oglesby | |
| 9,777,979 | B2 * | 10/2017 | Washburn, III | F41A 21/30 |
| 9,803,946 | B2 | 10/2017 | Schoenlau | |
| 10,119,779 | B1 * | 11/2018 | Miele | F41A 21/30 |
| 2010/0180759 | A1 | 7/2010 | Petersen | |
| 2012/0145478 | A1 * | 6/2012 | Brittingham | F41A 21/30 181/223 |
| 2012/0199415 | A1 | 8/2012 | Shults et al. | |
| 2016/0109205 | A1 * | 4/2016 | Coppinger | F41A 21/30 89/14.4 |
| 2018/0038663 | A1 | 2/2018 | LaRue | |

* cited by examiner

FIREARM SUPPRESSION DEVICE

CROSS REFERENCE TO RELATED APPLICATIONS

This application claims benefit to nonprovisional patent application Ser. No. 15/408,224, entitled "Firearm Suppression Device", filed on Jan. 17, 2017, which claims benefit to provisional patent application No. 62/279,801, entitled "Firearm Suppression Device", filed Jan. 17, 2016, which all are incorporated by reference in its entirety for all purposes.

FIELD OF THE INVENTION

The present invention pertains in general to the suppression of firearm and weapon systems to mitigate audible, visual and temperature profiles when in use.

BACKGROUND OF INVENTION

Firearms typically understood as a barreled weapon designed to launch a projectile toward an intended target have developed over centuries. Many developments have been made over the ages, but firearms have typically utilized the use of an explosive charge to create a rapidly expanding, controlled and directed volume of gas to propel a projectile out of the end of a barrel at high velocities.

A large factor in the creation of sound when discharging a firearm, often referred to as a report, is due to the escape and rapid and uncontrolled expansion of the explosive charge out of the muzzle-end wherein the projectile exits the firearm. This sound surrounding the escape of the rapidly expanding gas out of the muzzle-end of a firearm is often referred to as muzzle-blast.

Due to the explosive nature of the charge driving the projectile, the muzzle-blast is also often accompanied with muzzle-flash. Muzzle-flash is the visible light that exits the firearm from the muzzle-end associated with an explosive charge originating from within the firearm.

In many situations it is desirable to mask, muffle, suppress or otherwise mitigate the muzzle-blast and muzzle-flash of a firearm during use. The mitigation or suppression of these factors of a firearm may provide the operator with an increased tactical advantage and when operating in a covert manner. Some of the advantages associated with this increased tactical advantage over an intended target or enemy due to the suppression of the muzzle-blast include—increased difficulty in identifying the location of the firearm, masking the direction from which the firearm is firing, the reduction of noise levels to safe hearing levels, and the altering of a characteristic noise signature, which may indicate the distance, type or specific model of weapon.

A common solution to mitigate or suppress the muzzle-blast and/or muzzle-flash of a weapon surrounds the use of a suppressor, sometimes referred to as a "silencer" or "can," affixed to the muzzle-end of a weapon to provide an intermediate expansion volume for rapidly expanding gasses related to the firing of the weapon. This intermediate expansion volume allows the control of the muzzle-blast and muzzle-flash within an enclosed space prior to exiting the suppressor. This intermediate expansion volume also allows controlled expansion of gasses related to the explosive charge exiting the muzzle of the weapon. By the time the rapidly expanding gas from the explosive charge reaches the ambient environment, after passing through the intermediate expansion volume, the differential pressure between the explosive charge related gasses and the ambient air is decreased. A decreased differential pressure, results in a lesser audible signature when such gasses related to the explosive charge rapidly expand in the ambient air. The visual signature related to muzzle-blast and muzzle-flash is also decreased to a lesser level due to the intermediate expansion volume. This intermediate expansion volume is intended to suppress the audible and visual signatures, herein collectively referred to as "firearm signature," to levels offering increased tactical advantages.

The suppression of firearm signatures typically involves a device attached to the muzzle-end of a firearm to provide intermediate expansion volume and suppression of firearm signature with minimal or no impedance upon the trajectory or flight path of the projectile exiting the muzzle of the firearm.

A common problem with the use of suppressors in the field of firearm suppressors surround heat retained by the suppressor as well as an undesired phenomenon known as blowback. Blowback may occur with the use of a suppressor, through which rapidly expanding gasses enter a restricted volume of the suppressor and cannot escape entirely through an aperture provided for the flight path of a projectile or other venting apertures. As a result, a portion of the rapidly expanding gasses travel back down the barrel of the firearm back toward the operator of the firearm. Dependent upon the style of weapon, blowback gasses may exit the weapon through parts of a weapon including an ejection port, trigger assembly, bolt, receiver or charging handle area such as with a firearm disclosed U.S. Pat. No. 5,351,598 to Schuetz, herein incorporated in its entirety by reference. The effects of blowback include an increased rate of carbon deposits within the working mechanisms of the firearm, increased operating pressure within a weapon, increased wear and tear of a weapon, and a decrease in reliability of a weapon. Furthermore, blowback sometimes results in gasses exiting the weapon through previously discussed parts of the weapon after travelling back from the muzzle-end of the firearm and toward the operator. This blowback sometimes exits the weapon toward an operator's face and adversely affects the operator's vision or respiratory function, endangering the operator.

Another common problem surrounding the use of existing suppressor devices include factors that negatively affect an operator's interaction with the weapon. The attachment of a metallic suppressor device increases the weight of a weapon in an asymmetric manner that affects the operator's ability to use the weapon in a manner consistent with normal use. A weapon with increased weight affixed to the muzzle-end, or firing-end, of the weapon is no longer balanced as it would be in normal operation without the affixed suppressor. The can cause inconsistent firing accuracy as well as accelerated fatigue of the weapon operator.

Yet another problem associated with the use of existing suppressor devices is the increased operating temperatures of the exposed housing of the suppressor and other heat conductive parts of a firearm such as metal rails. In some scenarios, the operating temperature of a suppressor may exceed temperatures of 426° C. (800° F.). A rail, or Picatinny rail, and other parts of a firearm may be appreciated to include, for example, those described by U.S. Pat. No. 9,032,860 to Faxon (Faxon) and U.S. Pat. No. 3,236,155 to Sturtevant (Sturtevant), each herein incorporated by reference in their entirety. Contact with a heated surface, such as the exposed housing of a suppressor by the operator or others in near proximity of the firearm may result in injury and distraction to the operator. Distractions in certain environments, such as covert operations or dynamic situations may result in life-threatening consequences to an operator or those surrounding them. As operators in military scenarios often work in teams, these life-threatening consequences may also affect a team, within which the weapon operator works.

SUMMARY OF INVENTION

The present invention surrounds a suppressor for the mitigation of firearm signature while addressing problems associated with other existing devices in the field of firearm suppression.

Some existing suppressors attempt to mitigate firearm signature do so with a sealed metallic enclosure with internal baffling such as employed by U.S. Pat. No. 8,973,481 to Dueck, et al. (Dueck), herein incorporated by reference in its entirety. Dueck provides firearm signature mitigation with an intermediate expansion volume comprising a substantially sealed volume with openings at the distal ends for the passage of a projectile and associated expanding gasses. Where Dueck fails to address certain problems associated with the suppression of firearms is the issue surrounding blowback and excessive temperature retained by the suppressor.

Some suppressors attempt to provide increased suppression through the use of vent holes in the outer surface of the suppressor as used by U.S. Pat. No. 8,322,266 to Presz, et al. (Presz), herein incorporated by reference in its entirety. The vent holes in the outer surface of the suppressor described by Presz provide further mitigation of such issues of blowback and muzzle-flash suppression, however the design as disclosed by Presz in operation of a firearm, retains heat in excess of temperatures safe to the touch.

Some existing suppressor devices attempt to mitigate the high temperature issue as related to the operation of a firearm in conjunction with a suppressor device attached to the muzzle-end as used by U.S. Pat. No. 9,140,511 to Michal, et al. (Michal), herein incorporated by reference in its entirety. Michal describes a sleeve designed to interface with the outer surface of a suppressor with internal splines, and external splines disposed at an angle to the internal splines. The configuration of Michal provides insulation to limit heat conduction and limiting the external touch temperature of the sleeve when used with a suppressor. Michal fails to address problems associated with blowback. Furthermore, Michal's insulation strategy prevents the cooling of suppressor. This leaves the firearm subjected to negative operational effects of excessive heat retained by the firearm and suppressor device.

It will be appreciated that for the purposes of the present invention, a proximal designation surrounds a portion of an element being closer to an operator when such an element is used as intended. It will be further appreciated that for the purposes of the present invention, a distal designation surrounds a portion of an element being further from an operator when such an element is used as intended. Considering a firearm, for example as disclosed by Sturtevant, is appreciated to have a stock at a proximal end of the firearm and a barrel at a distal end of the firearm.

In certain embodiments of the present invention, a suppressor comprises a firearm engagement component at a proximal end of the suppressor. The firearm engagement component features a pathway along an attachment feature for the fixation to the muzzle-end of a firearm. The suppressor further comprises a projectile exit component at a distal end of the suppressor having an opening along a pathway allowing for the passage of a projectile and gasses. The suppressor further comprises a baffle system with a pathway disposed between the firearm engagement component and the projectile exit component, a sleeve, and an outer housing. Certain embodiments of a baffle system comprise a plurality of baffles. Certain embodiments of a baffle comprise a form of increasing cross-section with a pathway extending from the proximal end of the baffle to the distal end of the baffle. Such a pathway allows for the passage of a projectile through the suppressor without interference. Certain embodiments of such a baffle may further comprise apertures in the baffle through the outer surface of the baffle for the expansion of gasses and passage from a first volume on the interior of a baffle to a second volume on the exterior of a baffle. The baffle system is surrounded by the sleeve, which extends from a proximal portion of the suppressor to a distal portion of the suppressor. Gasses that pass from the first volume on the interior of a baffle, enter the second volume on the exterior of a baffle. The second volume is further defined by the inner surface of the sleeve. The sleeve serves to direct the expansion of gasses and may be configured to allow the passage of gasses from the second volume within the interior of the sleeve to a third volume external to the sleeve. In certain embodiments a sleeve is configured to allow the passage and expansion of gasses from the second volume to the third volume via through-holes located toward the distal end of the suppressor. Gasses that enter the second volume from the first volume, expand parallel to the pathway and toward the distal end prior passing through the through-holes. Gasses that expand into the third volume are initially contained between the outer surface of the sleeve and the inner surface of the outer housing. In certain embodiments, these gasses are permitted to expand within the third volume, between the sleeve and the inner surface of the outer housing, along the length the suppressor toward the proximal end of the suppressor. Toward the proximal end of the suppressor, the outer housing has apertures extending through the outer surface of the outer housing to the ambient air, allowing for the venting of gasses associated with the operation of a firearm to the ambient air.

BRIEF DESCRIPTION OF FIGURES

FIG. 1B—A perspective exploded cross-section view of an embodiment of a suppressor FIG. 2—A perspective view of an embodiment of a suppressor FIG. 3A—A perspective exploded view of an embodiment of a baffle FIG. 3B—A perspective exploded cross-sectional view of an embodiment of a baffle FIG. 4—A perspective cross-sectional view of an embodiment of a baffle system FIG. 5A—A perspective cross-sectional view of an embodiment of a suppressor FIG. 5B—A perspective exploded cross-sectional view of an embodiment of a suppressor FIG. 5C—A perspective exploded cross-sectional view of an embodiment of a suppressor FIG. 6—A perspective view of an embodiment of a suppressor FIG. 7—A side cross-sectional view of an embodiment of a suppressor

DETAILED DESCRIPTION

Figure 1A:
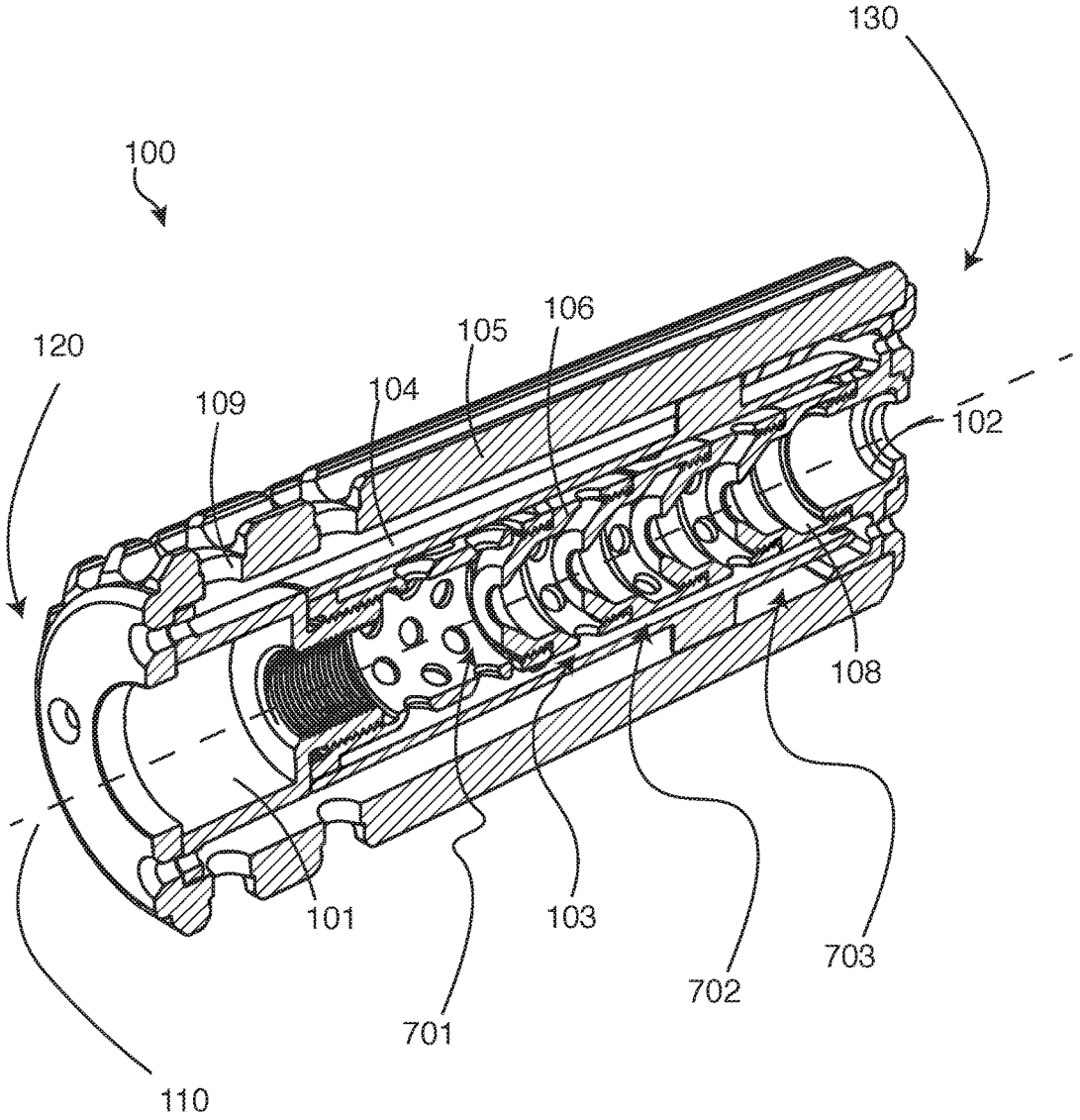
FIG. 1A—A perspective cross-sectional view of an embodiment of a suppressor
Figure 1B:
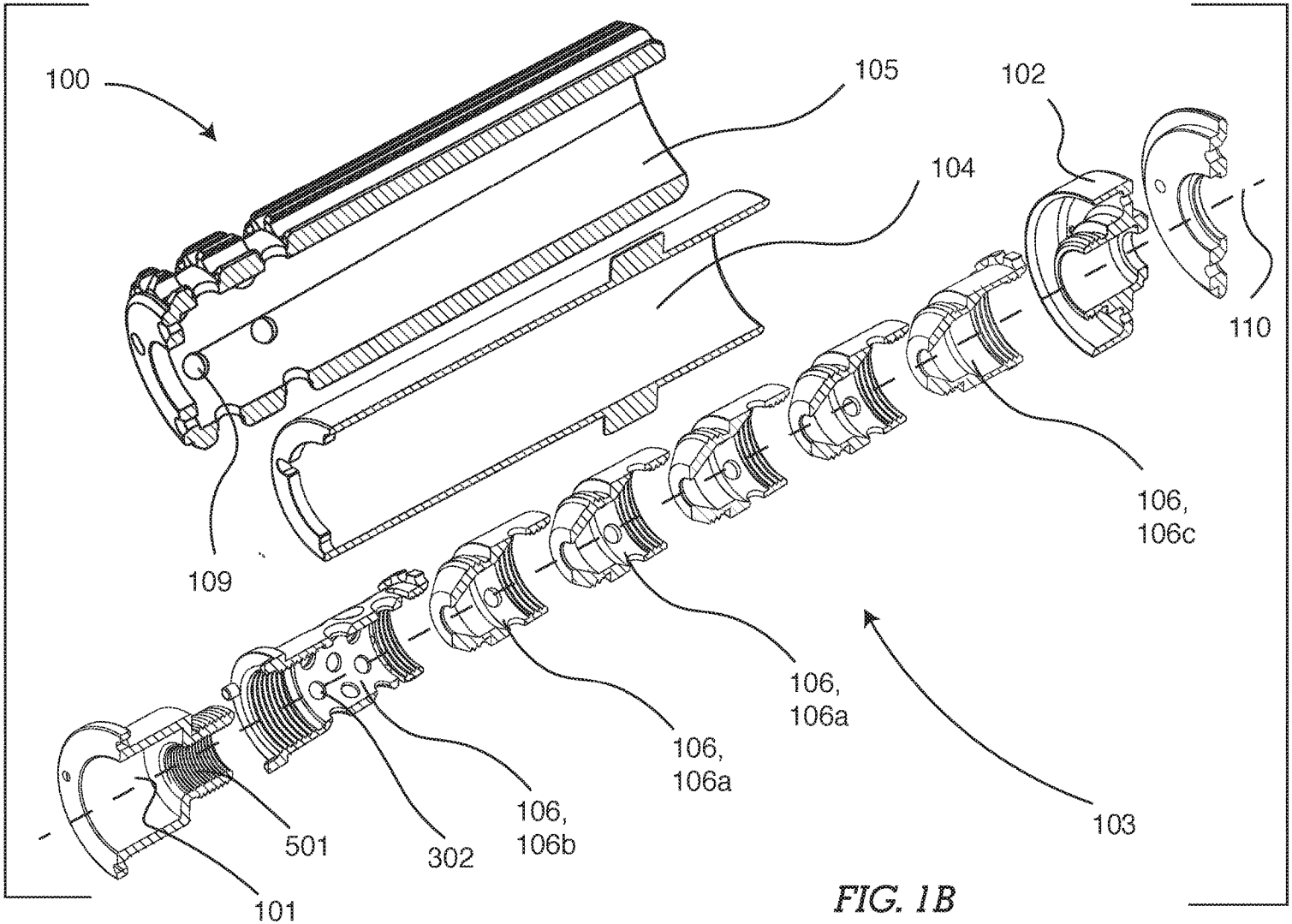

Certain embodiments of the present invention surrounding a suppressor 100, as shown in FIG. 1A and FIG. 1B, comprise a firearm engagement component 101 having a pathway 110 and a firearm attachment feature 501 for the fixation to a distal end of a firearm. Such a suppressor 100 has a proximal end 120 and a distal end of the suppressor 130 and further comprises a projectile exit component 102, a baffle system 103, a sleeve 104 and an outer housing 105. A projectile exit component 102 is open along a pathway 110, allowing for the passage of a projectile and gasses. Certain embodiments of a baffle system 103 comprise a plurality of interconnected baffles 106. A first baffle 106*a*, seen in FIG. 1B, comprises a hollow form with a cross-section increasing along the pathway 110 from a proximal end toward a distal end of the first baffle 106. A second baffle 106*b*, seen in FIG. 1B, comprises a constant internal diameter and constant outer diameter. The first baffle 106*a* and the second baffle 106*b* are interconnected such that the hollow form of each is consistent with the pathway 110. The outer surface of certain baffle, 106*a* and 106*b* for example, have apertures in the baffle 302 through an outer surface of the baffle for the expansion of gasses from the interior of the baffle system 103 to the exterior of the baffle system 103. A third baffle 106*c*, seen in FIG. 1B, comprises a hollow form with increasing cross-section along the pathway 110 from a proximal end toward a distal end of the third baffle 106*c*.

It will be appreciated that embodiments of baffle 106, shown in FIG. 1B, are not limited to the configuration disclosed and may comprise any form or cross-section having a hollow form aligning with the pathway 110. The alignment of the hollow form of a baffle 106 allows the passage of a projectile from a proximal portion of the baffle system 103 to a distal portion of the baffle system 103 without interference.

It will be further appreciated that a baffle system 103, shown in FIG. 1B is not limited to configurations disclosed herein and may comprise any combination of baffle 106 without departure from the inventive concept of the present invention. Certain embodiments a baffle system 103, may contain a plurality of baffles 106. Other embodiments of a baffle system 103 may comprise a singular baffle 106.

Certain embodiments of a baffle system 103, seen in FIG. 1A, are surrounded by a sleeve 104, which extends from a proximal portion of the suppressor 100 to distal portion of the suppressor 100. Gasses that pass from the first volume 701, through the baffle system 103, enter the second volume 702. The second volume 702 is bounded by the inner surface of the sleeve 104 and the outer surface of baffle system 103. The sleeve 104 only allows the passage of gasses from the interior of the sleeve 104 to the exterior of the sleeve 104 at a location near the distal end of the suppressor 100. The gasses that pass to the exterior of the sleeve 104 are initially contained within a third volume 703 defined by the outer surface of the sleeve 104 and the inner surface of the outer housing 105. These gasses are permitted to expand within the third volume 703 between the sleeve 104 and the outer housing 105 along the length of the suppressor 100 toward the proximal end 120 of the suppressor 100. Near the proximal end 120 of the suppressor 100, the outer housing 105 has apertures in the outer housing 109 to the ambient air, allowing for the exit of gasses associated with the operation of a firearm.

Although embodiments presented herein, as shown in FIG. 1A for example, surrounding the present invention are configured with a first volume 701, a second volume 702 and a third volume 703, it will be appreciated that additional volumes may be considered as within the inventive bounds of a suppressor as disclosed.

Figure 2:
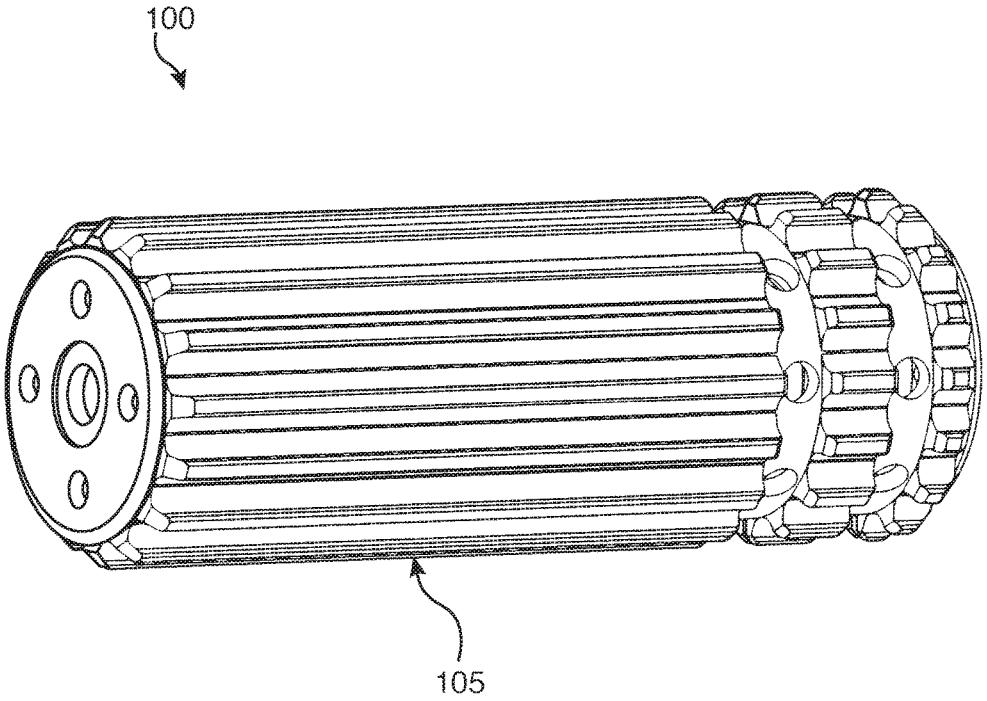
Figure 3A:
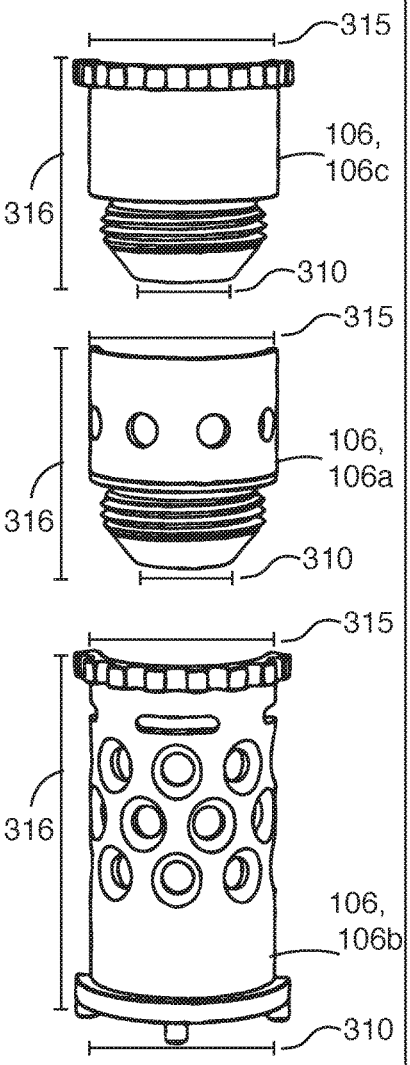
Figure 3B:
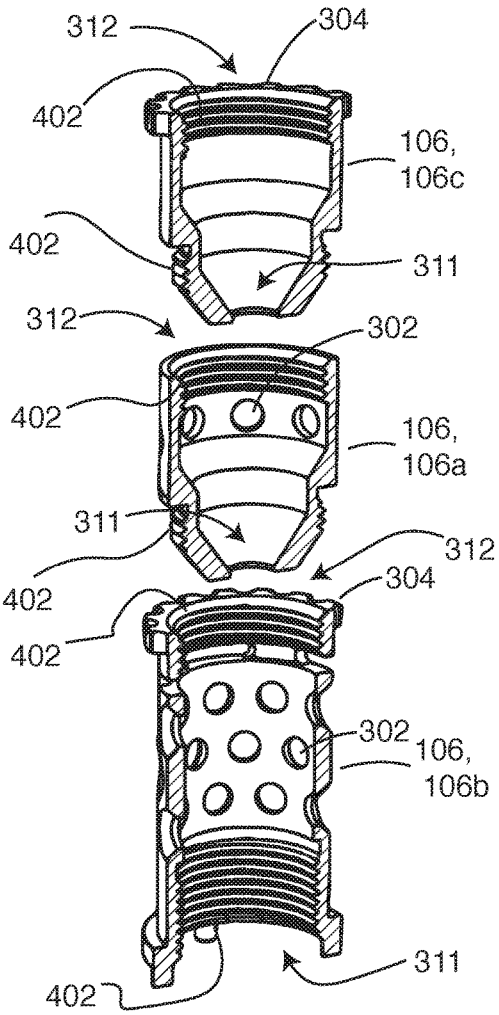

Certain embodiments of a suppressor 100, as shown in FIG. 2, comprise an outer housing 105 further comprising a material composition with a low heat transfer coefficient. Such material compositions may comprise ceramic, polymeric or other materials with a low heat transfer coefficient. Such materials further exhibit a melting temperature and heat deflection temperature, as dictated by the American Society of testing and Materials (ASTM), exceeding 500° C. (932° F.). Certain embodiments of a baffle system 103, as shown in FIG. 3A and FIG. 3B, comprise a plurality of baffles 106, each having a first dimension 310, a second dimension 315 and a length 316. It will be appreciated that in certain embodiments of some baffle (106*a*, 106*c*), a first dimension 310 is smaller than a second dimension 315. In other embodiments of a baffle 106*b* a first dimension 310 may be equal to a second dimension 315. Furthermore, each baffle 106 has a proximal opening 311 and a distal opening 312. A first baffle 106*a* for instance, comprises a hollow form with increasing cross-sectional dimension, from a first dimension 310 at a proximal portion of the first baffle 106*a* to a second dimension 315 at an open distal portion of the first baffle 106*a*. The proximal portion of the first baffle 106*a* has a proximal opening 311, less than or equal to the first dimension 310. The first baffle is configured such that gasses may pass axially into, expand through the baffle 106*a*, and exit through a distal opening 312 at a distal portion of the baffle 106*a*. Furthermore, such a first baffle 106*a* comprises apertures in the baffle 302 extending radially through the hollow form of the baffle 106*a*. Such apertures in the baffle 302 are typically biased toward a distal portion of the baffle 106. Apertures in a baffle 302 allow for the passage of gasses from the internal volume of a baffle 106*a* to the exterior of a baffle 106*b*.

As shown in FIG. 3A and FIG. 3B, it will be appreciated that a baffle 106 may take a plurality of forms as shown in FIG. 3A and FIG. 3B. It will be further appreciated that certain embodiments of a baffle 106, such as a third baffle 106*c*, do not require apertures in the baffle.

In certain embodiments, as seen in FIG. 3A and FIG. 3B, some baffles (106*b*, 106*c*) have at least one baffle standoff feature 304, extending radially outward from the outer surface of the baffle 106*b* and 106*c*. Baffle standoff features 304 as seen in FIG. 3B, provide offset between a baffle 106 or baffle system 103, and a sleeve 104 as shown in FIG. 1B. Certain embodiments of a baffle standoff feature 304, shown in FIG. 3B, are positioned toward a distal portion of a baffle 106. A baffle standoff feature 304 may comprise a continuous form, a continuous form with apertures for the passage of gas allowing for expansion, or a plurality of individual features extending radially from the outer surface of a baffle 106.

In other embodiments as shown in FIG. 3A and FIG. 3B, a baffle 106*b* comprises a cylindrical shell form with constant cross-sectional dimension and open ends. The cylindrical shell features apertures in the baffle 302 passing through the outer surface of the baffle 106*b* to the interior of the cylindrical shell form. The apertures in the baffle 302 may be evenly spaced, staggered or randomly positioned and allow for the passage of gasses from the interior of the baffle 106*c* to the exterior of the baffle. Furthermore, a baffle 106*c* may comprise alternative embodiments of apertures in the baffle 302 having differing shape and cross-sectional area.

It will be appreciated to one skilled in the art that expansion rate of a gas associated with a baffle 106, seen in FIG. 3A, is dependent upon multiple variables including the cross-sectional area of the baffle along the length of the baffle 106, apertures in the baffle 302 shape, number of apertures in the baffle 302 allowing passage to the exterior of the baffle and the length of a baffle 106.

Figure 4:
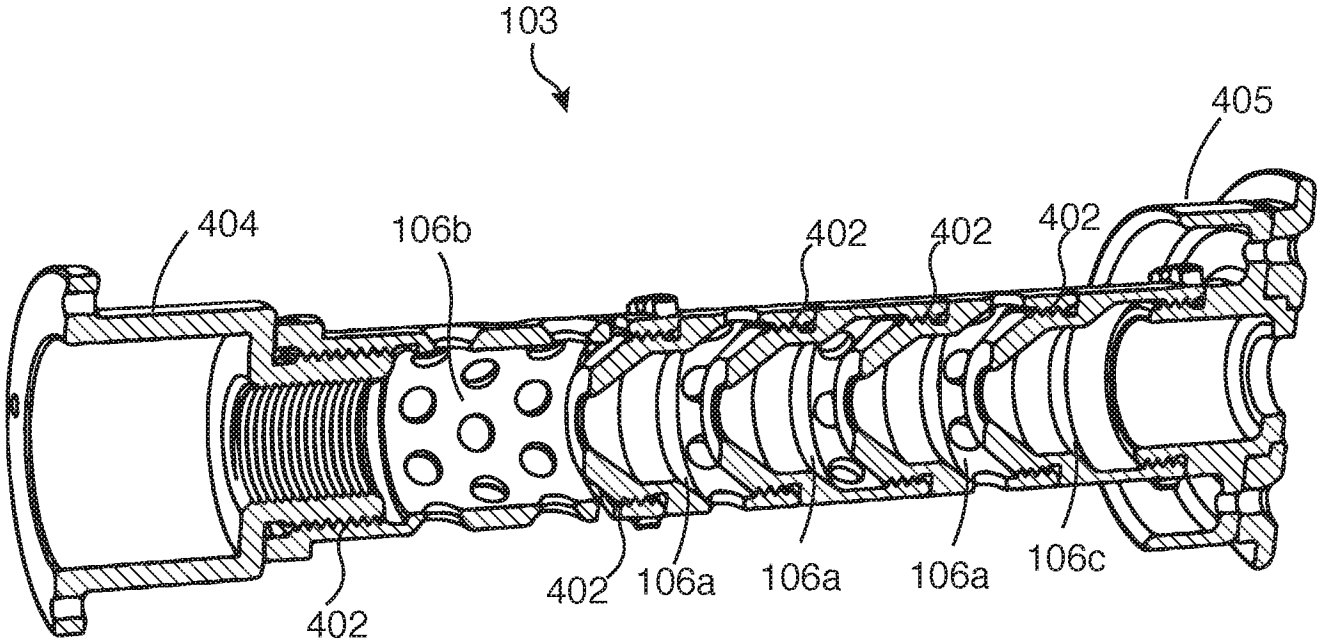

In certain embodiments of a baffle system 103 as shown in FIG. 4, a baffle 106 may further comprise baffle attachment features 402 for the fixation of the baffle 106 to other components including, but not limited to other baffle 106*a*, 106*b* and 106*c*, a firearm engagement component 404 of a suppressor or a projectile exit component 405 of a suppressor. Such attachment features include screw threading, pipe threading, male or female interlocking mechanisms. As seen in FIG. 3B, certain embodiments of a baffle 106 comprise a baffle attachment feature 402 at a proximal portion and a distal portion of such a baffle 106. Such baffle attachment features 402 allow the assembly and disassembly of a plurality of baffles 106.

Figure 5A:
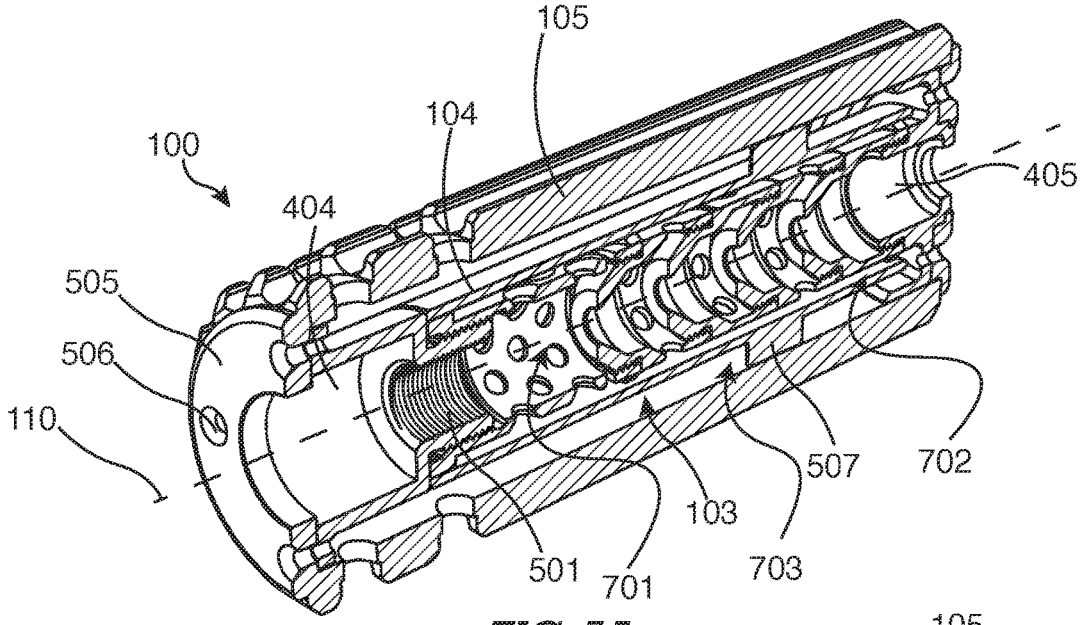
Figure 5B:
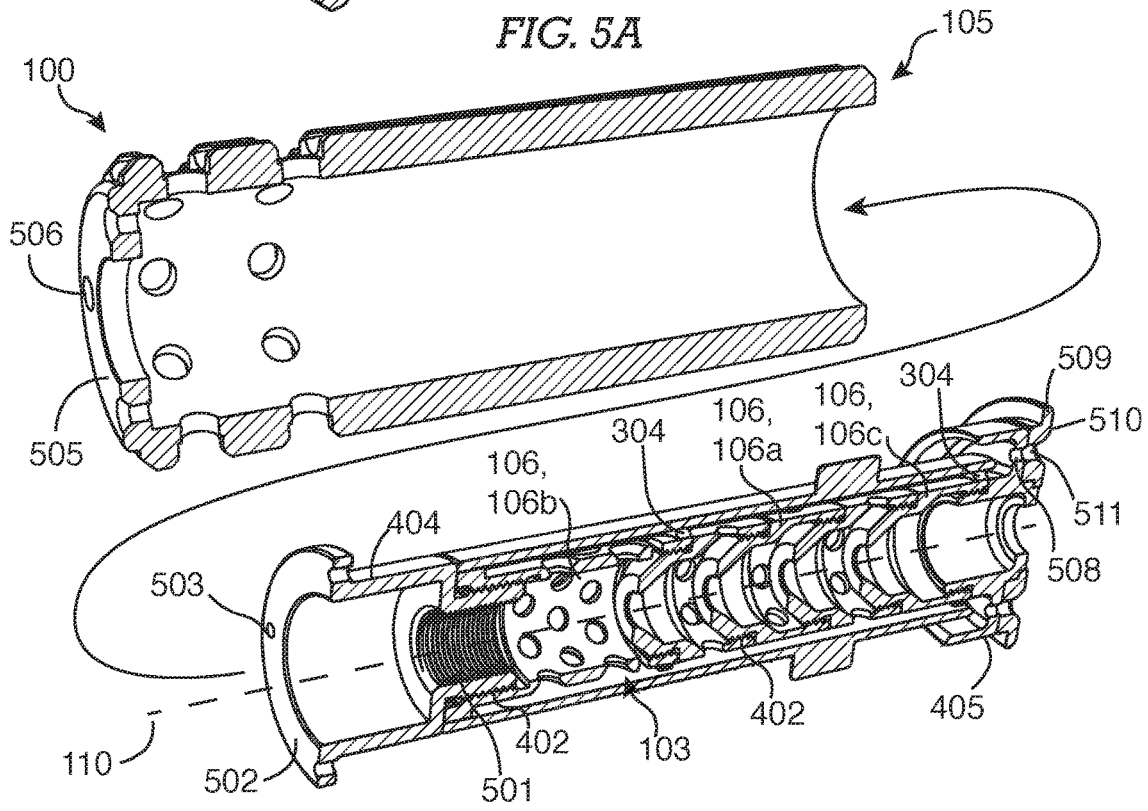

Certain embodiments of a baffle system 103, as shown in FIG. 5A and FIG. 5B, comprise a sleeve 104, a firearm engagement component 404, a projectile exit component 405 and an outer housing 105. The firearm engagement component, seen in FIG. 5B and FIG. 5C, 404 further comprises a projectile entry aperture 307 and a firearm attachment feature 501 for the fixation to the distal end of a firearm, and proximal face 520 comprising a flange feature 502 extending radially outward with a plurality of through-holes 503 in the firearm engagement component flange feature 502.

A suppressor 100, shown in FIG. 5B, further comprises a baffle system 103 having a plurality of axially affixed baffle 106 wherein the baffles 106 are attached to each other using baffle attachment features 402. The baffle 106 are configured to allow radial gas expansion as gasses flow along a pathway 110 through each consecutive baffle 106 and therein from proximal portion to a distal portion of the baffle system 103. A second baffle 106*b* at the proximal end 120 of the suppressor 100 further comprises a proximally located attachment feature 402 for fixation to the firearm engagement component 404 of the suppressor 100 and at least one baffle standoff feature 304. A third baffle 106*c* at the distal end of the suppressor 130 further comprises a distally located baffle attachment feature 402 for fixation to the projectile exit component 405 of the suppressor 100 and at least one baffle stand-off feature 304. A plurality of first baffles 106*a* are interconnected and extend from the second baffle 106*b* to the third baffle 106*c*. The projectile exit component 405, shown in FIG. 5C, further comprises a flange feature 504 extending radially outward. In some embodiments, the baffle stand-off features 304 of the most proximal baffle 106*c* and the most distal baffle 106*b* of the baffle system 103 provide support for the sleeve 104 disposed around the baffle system. The baffle stand-off features 304 offset the sleeve 104 at a consistent distance from the pathway 110 of the suppressor 100.

Figure 5C:
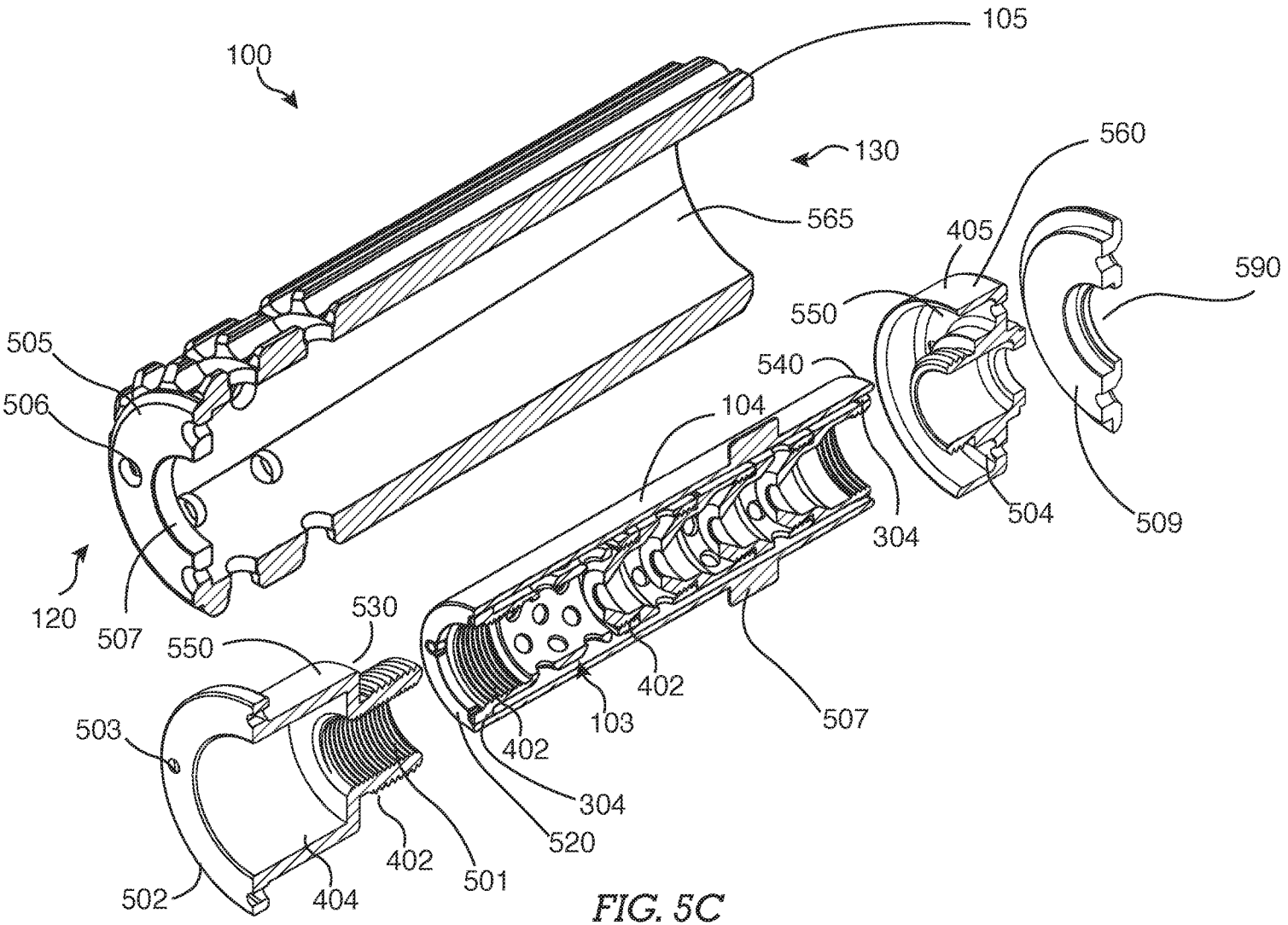

In certain embodiments of a suppressor as seen in FIG. 5C, a proximal face 520 of a sleeve 104 interfaces with a distal face 530 of the firearm engagement component 404 for fixation to each other. This fixation seals the intersection of the sleeve 104 and the firearm engagement component 404 to prevent the passage of gasses from between the sleeve 104 and the firearm engagement component 404. A distal edge 540 of the sleeve 104 is offset from a proximal face 550 of the projectile exit component 405. Offsetting the sleeve 104, referencing FIG. 5A, from the firearm engagement component 104 allows the passage of gasses between a second volume 702 within of the sleeve 104 to a third volume 703 defined by the exterior of the sleeve 104 and the inner surface of the outer housing 105. The outer housing 105, shown FIG. 5B, and FIG. 5C, comprises a cylindrical shell-form open at a distal end of the suppressor 120 and an aperture at the proximal end of the suppressor 130. A flange feature 505 configured proximally on the outer housing 105 extends radially inward from the cylindrical shell form. The flange feature 505 further exhibits an aperture 507, which is typically centrally located. The flange feature 505 of the outer housing 105 has through-holes 506 of configuration matching through-holes 503 of the firearm engagement component 404 flange feature 502. The outer housing 105 is disposed surrounding the assembly of the firearm engagement component 404 and the projectile exit component 405, with baffle system 103 and sleeve 104 therebetween. In such an assembly the outer housing flange feature through-holes 506 align with the through-holes in the flange feature of the firearm engagement component 503.

In certain embodiments of a suppressor, shown in FIG. 5C, an outer surface 550 of a firearm engagement component 404 flange feature 502 and an outer surface 560 of a projectile exit component 405 provide engagement with the inner surface 570 of an outer housing 105 for axial constraint. Optionally, the sleeve 104 may further comprise offset features 507 for engagement with the inner surface 565 of the outer housing 105 for additional axially constraint. Referencing FIG. 5B and FIG. 5C, fastening hardware inserted through the aligned outer housing flange feature through-holes 506 and the through-holes in the flange feature of the firearm engagement component 503 provide longitudinal constraint. Optionally, the projectile exit component flange feature 504 may further comprise a plurality of through-holes 508, wherein an end-cap 509, intended to provide more structural constraint stability and/or gas sealing, further comprises a flange feature 510. The end-cap flange feature 510 has a projectile exit aperture 590 aligning with a pathway 110 and a baffle system 103 and further comprises a plurality of through-holes 511. The through-holes 511 of the end-cap 509 flange feature 510 matching the configuration of the projectile exit component flange feature through-holes 508 intended for the engagement of fastening hardware. Engagement of fastening hardware through the aligned through-holes 508 and 511 constrains an end-cap 509 to the projectile exit component 405.

Figure 6:
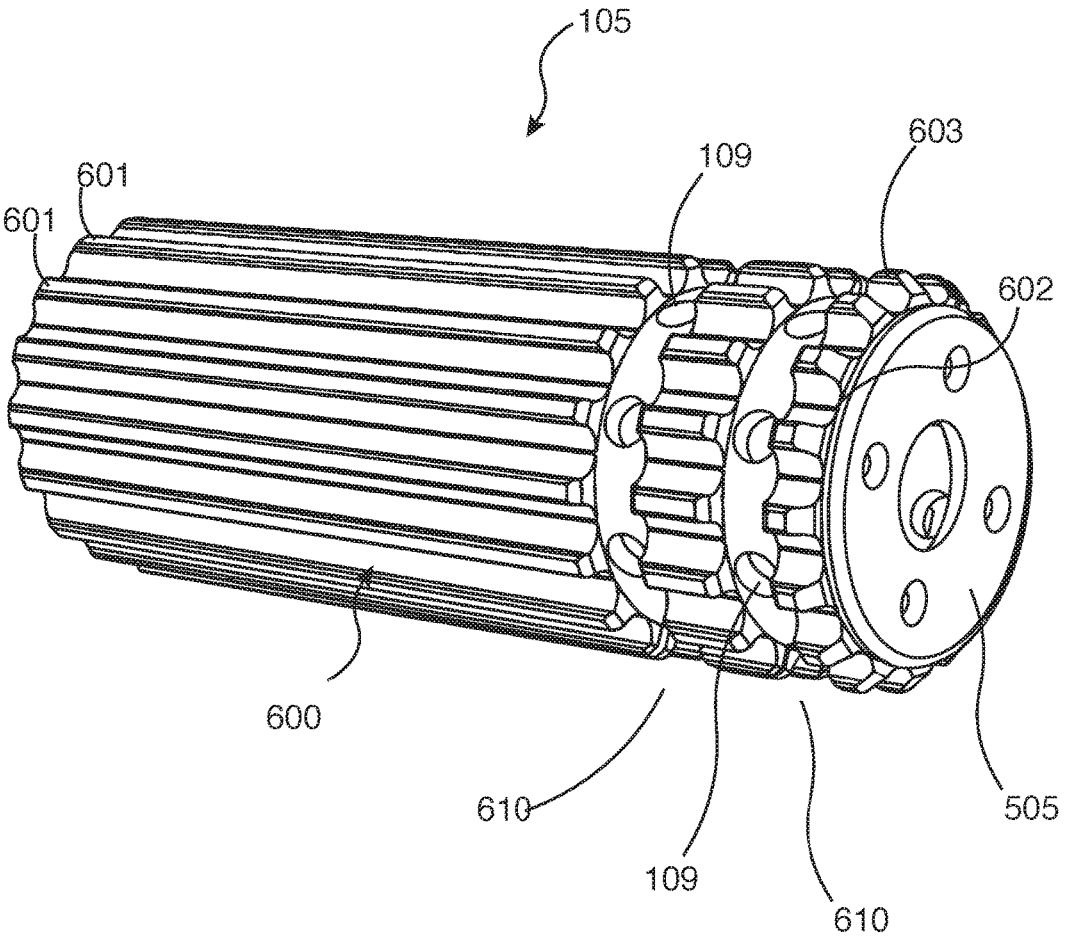

In certain embodiments, outer housing 105, shown in FIG. 6 further comprises at least one aperture in the outer housing 109. Other embodiments of an outer housing 105 comprise a plurality of apertures in the outer housing 109 offset from a distal portion of the outer housing 105. Such apertures in the outer housing 109 extend from the exterior to the interior of the outer housing 105. In some embodiments, a plurality of apertures in the outer housing 109 are used. In such embodiments, the apertures in the outer housing 109 are typically configured in a plurality of radial planar patterns 610, with each radial planar pattern 610 parallel to the outer housing flange feature 505. The radial planar patterns 610 of apertures in the outer housing 109 are typically offset from each other and proximate to the proximal end of the outer housing 105. It will be appreciated that any configuration of a plurality of apertures in the outer housing 109 may be used.

In certain embodiments of a suppressor 100 as shown in FIG. 6, the outer surface 600 of an outer housing 105 comprises a plurality of geometric features 601 extending radially away from the outer surface 600 of the outer housing 105. It will be appreciated that such geometric features 601 further comprise a minimum external profile 602, more proximate to the outer housing 105 outer surface 600. Under normal operating use, the minimum external profile 602 will typically exhibit a higher surface temperature than a maximum profile area 603. It will be further appreciated that a maximum external profile 603 is offset radially outward from the outer housing 105 outer surface 600. Outer housing 105 geometric features 601 provide benefits including but not limited to increased heat mitigation and offset surface providing a lower temperature user interface surface to mitigate burns and other potential injury. It will be appreciated that such geometric features 601, as shown in FIG. 6, are not limited to the embodiments as shown. Geometric features 601 may comprise a number of shapes, sizes and configurations while remaining consistent with the inventive nature of the present invention.

It will be appreciated that an increase in number of apertures in the outer housing 109 as shown in FIG. 6, or an increase of cross-section of an aperture in the outer housing 109 serves to increase gas exit airflow. It will be further appreciated that apertures in the outer housing 109 are not limited to a configuration involving two radial planar patterns 610 and may be configured in any configuration appreciated by one skilled in the art. This may include, but is not limited to, an array configuration, a randomized configuration or a spiral configuration.

Figure 7:
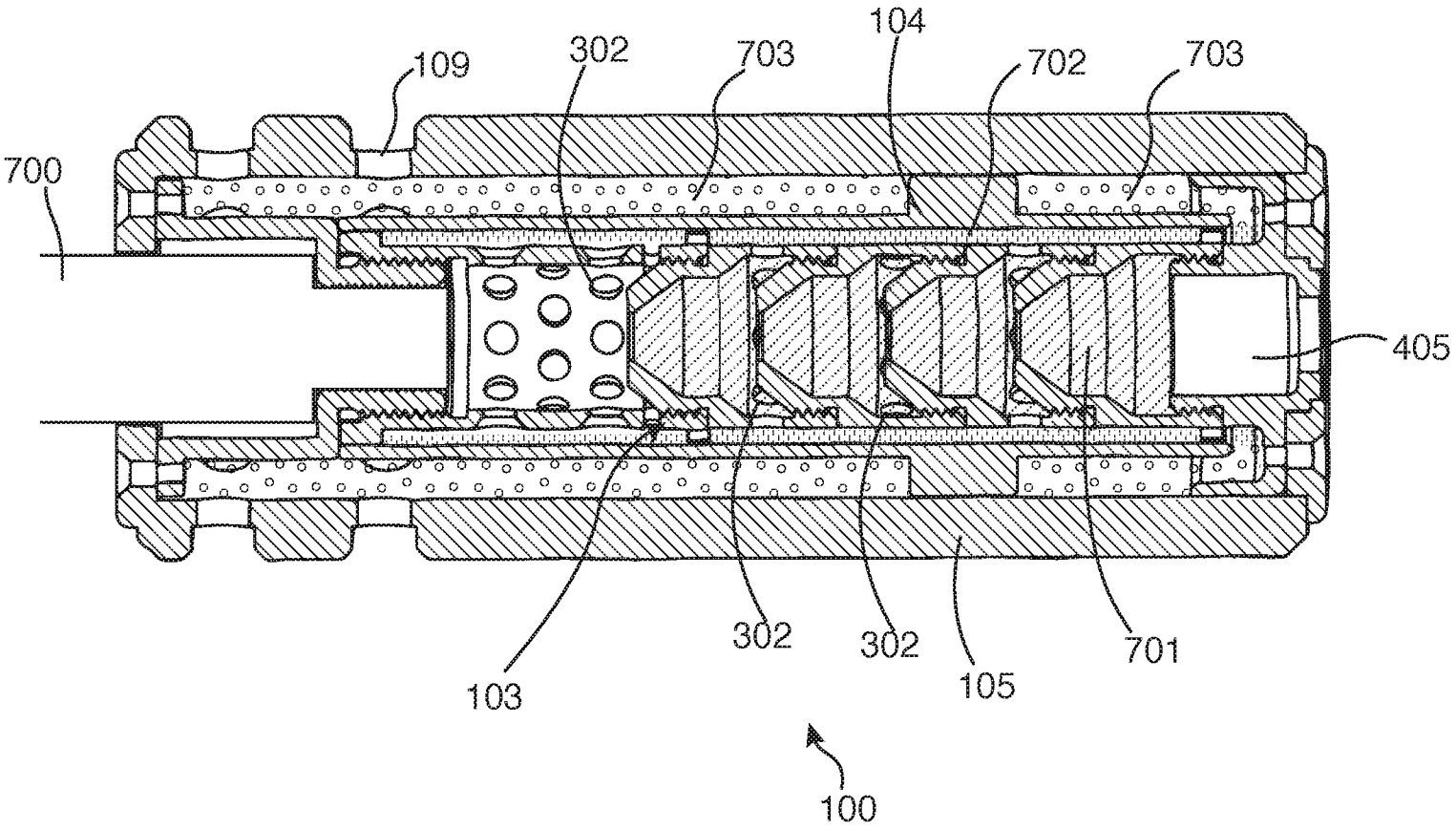

In certain embodiments of the invention shown in FIG. 7, a suppressor 100 comprises three internal gas expansion volumes defined by the assembly of a suppressor 100. A first volume 701 comprises the internal volume of a baffle system 103. A second volume 702 comprises the volume between the outer surface of a baffle system 103 and the inner surface of a sleeve 104. A third volume 703 comprises the volume between the outer surface of a sleeve 104 and the inner surface of an outer housing 105. When a firearm 700 to which the suppressor 100 is affixed is fired, gasses expand from the distal end of a firearm 700 into the suppressor 100, the gasses expand axially along the length of the first volume 701 toward the distal end of the suppressor 120. At the distal end of the suppressor 130, while expanding radially into the second volume 702 through apertures in the baffle 302. Some gasses exit the suppressor 100 through a projectile exit component 405 while other gasses expand into the second volume 702. The gasses expanding through the second volume 702, expand toward the distal end of the suppressor 100 where an offset of the distal edge of the sleeve 104 from a proximal planar surface of the projectile exit component 405 allows the expansion of gasses from the second volume 702 into the third volume 703. Gasses expand from the distal end of the third volume 703, toward the proximal end 120 of the suppressor 100. Apertures in the outer housing 109 in the outer housing 105 allow the expansion of gasses from the third volume 703 to the surrounding environment. In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "first," "second," "proximal," "distal," etc., as used herein, are intended for illustrative purposes only and do not limit the embodiments in any way. Additionally, the term "plurality," as used herein, indicates any number greater than one, either disjunctively or conjunctively, as necessary, up to an infinite number. The benefits, advantages, solutions to problems, and any element(s) that may cause any benefit, advantage, or solution to occur or become more pronounced are not to be construed as a critical, required, or essential features or elements of any or all the claims.

What is claimed:

1. A firearm suppression device comprising:

a baffle system comprising a plurality of interconnected baffles and a pathway therethrough, the pathway extending from a proximal end of the baffle system to a distal end of the baffle system;

the baffles having a proximal end and a distal end, the distal end of a first baffle configured to affix to the proximal end of a more distally located second baffle; and the baffle system having apertures extending radially from the pathway to an outer surface of the baffle system;

an outer housing having a substantially hollow form disposed around the baffle system;

an inner surface of the outer housing radially offset from the outer surface of the baffle system;

the outer housing comprising apertures extending from an inner surface of the outer housing to an outer surface of the outer housing, a sleeve disposed around the baffle system, between the baffle system and the outer housing;

the sleeve having an inner surface offset from the outer surface of the baffle system, and the sleeve having an outer surface offset from the inner surface of the outer housing; and the sleeve having a sealed proximal end, a sealed body extending from the proximal end to a distal end, and an opening at the distal end of the sleeve, wherein the firearm suppression device is affixed to the distal end of a firearm and gasses associated with the operation of the firearm expand into the baffle system, expand through the apertures in the baffle system, through the open distal end of the sleeve, and through the apertures of the outer housing to an exterior of the outer housing.

2. The device of claim 1, wherein said outer housing further comprises geometric features extending radially outward from an outer surface of said outer housing.

3. The device of claim 1, wherein the outer housing comprises a sealed proximal end and a sealed distal end.

4. The device of claim 3, wherein the pathway comprises a first volume;

the offset between the outer surface of the baffle system and the inner surface of the sleeve comprising a second volume; and the offset between the outer surface of the sleeve and the inner surface of the outer housing comprising a third volume, wherein gasses associated with the operation of a firearm expand through the first volume, through the apertures in the baffle system to the second volume, expand in a distal direction, expand into a third volume, expand proximally, and finally exit through the apertures in the outer housing to the exterior of the outer housing.

5. The device of claim 1, wherein said outer housing comprises a polymeric material.

6. The device of claim 1, wherein the plurality of baffles are interconnected using male and female interlocking mechanisms.

7. The device of claim 6, wherein the male and female interlocking mechanisms comprise screw threading.

8. The firearm suppressor device of claim 1 wherein said plurality of apertures in the outer housing are arranged in a radial planar pattern.

9. The firearm suppressor device of claim 1 wherein said outer housing further comprises geometric features extending radially outward from an outer surface of said outer housing.

* * * * *